US005533089A

United States Patent [19]

Mulhern

[11] Patent Number: 5,533,089

[45] Date of Patent: Jul. 2, 1996

[54] X-RAY COLLIMATING AND BODY SHIELDING ACCESSORY INSTRUMENT

[76] Inventor: Phoebe Mulhern, 162 Pawnee St., Ronkonkoma, N.Y. 11779

[21] Appl. No.: 383,977

[22] Filed: Feb. 6, 1995

[51] Int. Cl.[6] ..... G21K 1/02

[52] U.S. Cl. ..... 378/150; 378/160

[58] Field of Search ..... 378/145, 147, 378/149, 150, 152, 153, 160, 156, 157, 158

[56] References Cited

U.S. PATENT DOCUMENTS 2,331,586 10/1943 Waisco ..... 378/153

FOREIGN PATENT DOCUMENTS 2371911 7/1978 France ..... 378/150

*Primary Examiner*—Don Wong

*Attorney, Agent, or Firm*—Nicholas J. Garofalo

[57] ABSTRACT

The invention is an instrument comprising a unit having a frame defining the perimeter about an aperture, and a manually adjustable rack connected to the frame for supporting the unit with its aperture disposed between a source of x-rays and the body of a patient. Radio-opaque flexible panels depending from the frame are pivotable relative to the aperture to collimate and limit x-rays issuing from the source through the aperture to a particular area of the body of the patient. Translucent ports along lower edges of the panels serve to provide upon a photographic film below the patient a scale indication of the area of the body of the patient subjected to the x-rays.

11 Claims, 1 Drawing Sheet

X-RAY COLLIMATING AND BODY SHIELDING ACCESSORY INSTRUMENT

BACKGROUND OF THE INVENTION

This invention relates to an instrument for use in limiting the transmission of x-rays from a radiological source to a particular area of the body of a patient while at the same time shielding surrounding areas of the body from such rays. It is an instrument that is independent of and employed as an accessory to the x-ray source. It is designed, when put to use, to interpose and support between the x-ray source and the patient a unit that is adjustable to collimate and limit x-rays issuing from the source onto the particular area of the patient's body while also shielding surrounding areas of the patient from such rays.

More particularly, it is an object of this invention to provide, as an accessory in the employment of x-ray issuing devices, a manually operable and adjustable instrument of a simple and uncomplicated nature, an instrument which serves to achieve the beneficial results intended, primarily, limiting x-rays issuing from a radiological source to an area where needed upon the body of a patient and shielding surrounding areas of the body from such rays.

A further object of the invention is to provide an instrument for the foregoing purpose, which is simple in structure, practical in its mode of use, and effective in accomplishing the results intended.

BRIEF SUMMARY OF THE INVENTION

In accordance with the invention there is provided an instrument which includes a unit having a multisided continuous frame defining the perimeter about a complementary aperture. To the sides of the frame are hinged depending panels in the nature of shields or shutters comprised of radio-opaque material. The unit is supported by its frame to an end of a rack. The rack is manually extendible to position the unit with the aperture of the unit exposed between an x-ray emitting source and a particular area of the patient's body. The shields are manually adjustable about the frame relative to the x-ray source and the body of the patient to vary the size of the aperture in a manner for the shields to collimate and limit flow of x-rays issuing from the source through the aperture to the particular area of the patient's body; and the radio-opaque material of the shields also serves to shield surrounding areas of the patient's body from the rays. The unit and the rack define an instrument embodying the invention.

The foregoing, as well as other features, objects and advantages of the invention will appear more fully hereinafter from a consideration of the detailed description which follows, when taken together with the accompanying drawing wherein an embodiment of the invention is illustrated. It is to be expressly understood, however, that the drawing is for purposes of illustration and description, and it is not to be construed as defining the limits of the invention.

DETAILED DESCRIPTION OF THE INVENTION

Figures 1, 2, 3, 4, 5:
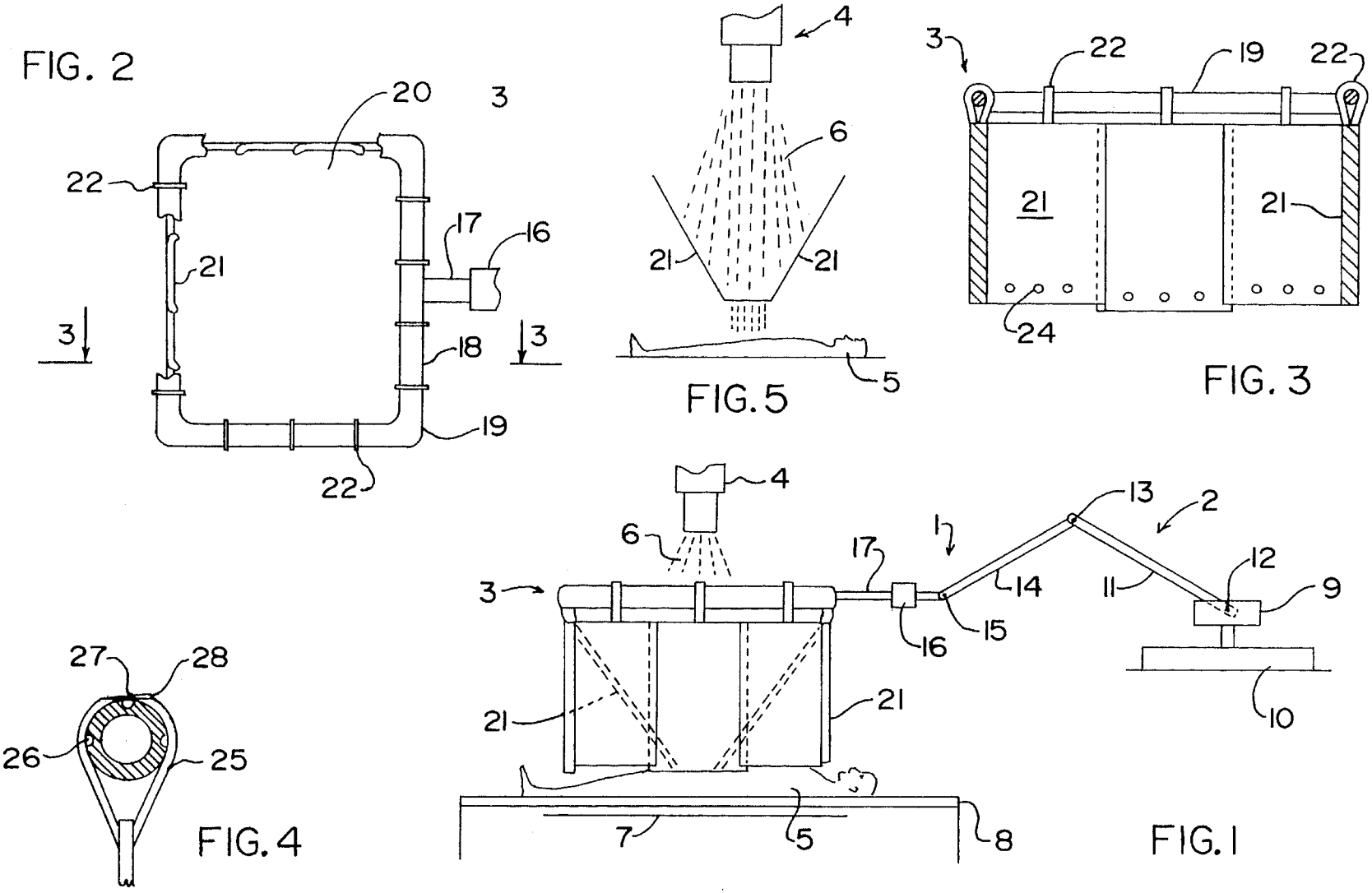
FIG. 1 discloses an instrument embodying the invention, in which view a unit mounted to an end of an extendible rack is positioned by the rack with the aperture of the unit disposed between a source of x-rays and the body of an underlying patient for the purpose of collimating and focusing issuance of the rays from the source through the aperture onto a particular area of the body while at the same time shielding surrounding areas of the body from such rays; the broken lines in the unit are illustrative of radio-opaque panels depending from the unit which have been adjustably pivoted inwardly from the sides of the unit to vary the size of the aperture so as to effect collimation of the rays from the source and exit of the rays from the aperture to a particular area of the body below.
FIG. 2 is a top plan view of the unit shown apart from the supporting rack, in which view portions of the frame of the unit are broken away to show the location of the radio-opaque panels depending from the frame.
FIG. 3 is an enlarged section taken on line 3—3 of FIG. 2.
FIG. 4 is an enlarged detail view illustrating a spring biased detent engagement of a hinge element of a depending panel to the frame of the unit.
FIG. 5 is a schematic showing of the diverging x-rays issuing from the source into the unit and exiting collimated onto a particular area of the body below.

Reference is now directed to the accompanying drawing, wherein there is shown in FIG. 1 apparatus disclosing the invention and illustrating its mode of use. An instrument, indicated generally by the numeral 1, embodies the invention. It comprises a rack 2 and a unit 3 supported by the rack. The function of the rack is to support and position the unit between an x-ray emitting device or source 4 and the body 5 of a patient. The function of the unit is to collimate and limit rays 6 issuing from the source to a particular area of the body, and also to shield from the rays areas of the body surrounding the particular area. A photographic film 7 is disposed below a conventional table 8 supporting the body to obtain a representation of the x-rayed area of the body.

As a means for supporting the unit relative to the source of x-rays and the body of the patient, the rack 2 may, accordingly, take various forms for such purpose. Here, a practical form of the rack for such purpose is illustrated. The rack 2 has a rear element 9 mounted for swivel movement relative to a support 10. A strut 11, pivoted at its rear end 12 to the element 9, is pivoted at its opposite end 13 to a second strut 14. The latter is pivoted at its forward end 15 to a universal joint 16, which in turn is swiveled upon a short rod 17 extending from a side 18 of a frame member 19 of the unit 3. Key elements defined by the pivots at the various joints of the rack are manipulative to make secure adjusted positions of the related components of the rack to one another. The rack is manually adjustable and extendible to position and support the unit 3 between the source 4 of x-rays and the body 5 of the patient.

The frame member 19 of the unit 3 is multi-sided, preferably rectangular in configuration; and it is formed of cylindrical rod of aluminum or other lightweight material. The frame defines a continuous perimeter about an aperture 20, which aperture serves for passage of x-rays from the source 4 to a body 5 located beneath the unit.

Depending from each of the sides 18 of the frame 19 of the unit 3 are separate panels 21 of flexible radio-opaque material, such as is provided by lead sheeting, or lead impregnated vinyl. Each panel is pivotally supported by a hinge 22 to the related side of the frame. The several panels may, accordingly, be selectively pivoted to one another about the frame to vary the size opening of the aperture at its bottom end. The panels are preferably rectangular in form and serve, when adjustably pivoted relative to one another, to define and limit as needed the dimension of the bottom or outlet end of the aperture 20, whereby x-rays issuing from the source 4 through the aperture are concentrated, limited and collimated as desired to impinge upon a particular area of the body of a patient underlying the aperture of the unit 3. Impingement of any of the rays upon a panel defining the aperture is absorbed by the radio-opaque material of the panel and, accordingly, is shuttered from contact with surrounding areas of the body of the patient; and only that portion of the rays intended to impinge upon the body of the patient passes through the aperture of the unit. In effect, as the panels about the frame of the unit are selectively pivoted to adjusted positions relative to one another, the direction of x-rays issuing from the source through the aperture of the unit to the body of a patient may be collimated, limited and beneficially controlled. The flexible nature of the panels enables portions of the panels which may be in contact with the body of the underlying patient to be flexed about the body.

The several panels of the unit are provided with translucent perforations 24 along their lower ends. X-rays which may pass through these perforations and register upon the film 7 below the patient provide a scale indication of the size of the exit end of the aperture from which the rays project to the body of the patient.

The several hinges 22 supporting the panels to the frame 19 of the unit 3 have a friction engagement with the frame, whereby they are held in their pivoted positions about the frame until the panels are re-pivoted to other positions.

In FIG. 4 is shown a modified form of a hinge 25 which may be employed in supporting a panel to the frame of the unit. This hinge is in the form of a band which sleeves a ring of closely spaced holes 26 formed in the related tubing of the frame. A ball detent 27 disposed in a hole of the hinge is adapted under the load of a leaf spring 28 mounted to the hinge to engage in part in one of the holes 26 of the frame accordingly as the panel is pivoted about the frame, whereby the pivoted position of the related panel is adapted to be secured. And, it is apparent that as the panel is manually pivoted, its pivoted position and detent engagement about the frame may be readjusted, and the dimension of the aperture for passage of x-rays from the source to the body of the patient may be varied.

While an embodiment of the invention has been illustrated and described in detail, it is to be expressly understood that the invention is not limited thereto. Various changes of form, design and arrangement may be made in its components without departing from the spirit and scope of the invention as the same will now be understood by those skilled in the art; and it is my intent, therefore, to claim the invention not only as shown and described, but also in all such forms and modifications thereof as may be reasonably construed to fall within the spirit of the invention and the scope of the appended claims.

What is claimed is:

1. An instrument comprising a unit having a central aperture, and manually operable rack means supporting said unit for locating the aperture of the unit between a subject and a radiological source, said unit being positionable proximal to the subject and independent of said source for the purpose of exposing a desired area of the subject to radiological exposure while shielding its surrounding areas, and wherein radio-opaque shutters hinged to the unit are manipulative to obtain adjustments in the size, shape and perimeter of said aperture for radiological exposure of the desired area of the subject, wherein the unit has a multisided frame defining the aperture, and the radio-opaque shutters are hinged to sides of the frame, wherein the shutters are flexible, and wherein an x-ray photographic film is disposed below the subject, translucent perforations are provided along the bottom sides of the shutters, which sides are opposite to and facing the hinged sides, and x-rays passing through the perforations and registered upon the film provide a scale indication of the size of the aperture.

2. An instrument comprising a unit having a central aperture, and manually operable rack means supporting said unit for locating the aperture of the unit between a subject and a radiological source, said unit being positionable proximal to the subject and independent of said source for the purpose of exposing a desired area of the subject to radiological exposure while shielding its surrounding areas, and wherein radio-opaque shutters hinged to the unit are manipulative to obtain adjustments in the size, shape and perimeter of said aperture for radiological exposure of the desired area of the subject, wherein the unit has a multisided frame defining the aperture, and the radio-opaque shutters are hinged to sides of the frame, wherein the shutters are flexible and wherein the frame of the unit is formed of rod.

3. An instrument as in claim 2, wherein the rod is cylindrical and the frame is rectangular in form.

4. An instrument as in claim 2, wherein the rod is tubular.

5. An instrument comprising a unit having a central aperture, and a manually operable rack supporting swivelly at one end thereof said unit for locating the aperture of the unit between a subject and a radiological source, said unit being positionable by means of said rack proximal to the subject and independent of said source for the purpose of exposing a desired area of the subject to radiological exposure while shielding its surrounding areas, wherein radio-opaque shutters hinged to the unit are manipulative to obtain adjustments in the size, shape and perimeter of a bottom end of the aperture for radiological exposure of the desired area of the subject, wherein the unit has a frame of continuous tubing defining the perimeter of the aperture, the radio-opaque shutters are hinged to and depend from the tubing of the frame, and wherein detent means engages the hinged shutters with the tubing.

6. An instrument comprising a unit having a frame continuous in in its form defining the perimeter about an aperture, an extendible rack having one end mountable to a support and having an opposite end with a universal joint connection to the frame allowing variable movement of the frame relative to the rack, wherein panels of radio-opaque material are hinged to and depend in a vertical plane from the frame about the aperture, the rack is manually extendible to position the unit with its aperture disposed below a source of x-rays and above a selected area of a patient's body, the panels are pivotably adjustable about the frame relative to one another to vary the size of a bottom outlet end of the aperture above the patient's body and to limit x-rays issuing from the source to the particular area of the patient's body, each panel is pivotable to a selected position about the frame, and each hinge has a pressured engagement with the frame, whereby the associated panel is retained under pressure in its pivoted position.

7. An instrument as in claim 6, wherein the frame in its form is a continuous tube defining the perimeter of the aperture.

8. An instrument as in claim 6, wherein the frame in its form is a continuous rod defining the perimeter of the aperture.

9. An instrument as in claim 6, wherein each hinge has a spring pressured detent engagement with the frame whereby the associated panel is retained under spring pressure in its pivoted position.

10. An instrument as in claim 6, wherein each hinge has a spring pressured engagement with the frame whereby the associated panel is retained under spring pressure in its pivoted position.

11. An instrument as in claim 6, wherein each hinge has a friction pressured engagement with the frame whereby the associated panel is retained under friction pressured engagement in its pivoted position.

* * * * *